US006170821B1

(12) United States Patent
Kubota

(10) Patent No.: US 6,170,821 B1
(45) Date of Patent: Jan. 9, 2001

(54) SHEET SORTING DEVICE

(75) Inventor: Kazuyuki Kubota, Yamanashi-ken (JP)

(73) Assignee: Nisca Corporation, Yamanashi-ke (JP)

( * ) Notice: Under 35 U.S.C. 154(b), the term of this patent shall be extended for 0 days.

(21) Appl. No.: 09/060,418

(22) Filed: Apr. 15, 1998

(30) Foreign Application Priority Data

Apr. 15, 1997 (JP) ..... 9-114365

(51) Int. Cl.[7] ..... B65H 39/10

(52) U.S. Cl. ..... 271/288; 271/258.01; 271/265.01; 271/294; 271/296; 271/302; 271/207; 271/176

(58) Field of Search ..... 271/258.01, 265.01, 271/288, 292, 293, 294, 296, 298, 302, 176, 207, 9.03, 220; 399/403, 405; 270/58.18, 58.19

(56) References Cited

U.S. PATENT DOCUMENTS 4,141,546 * 2/1979 Queener ..... 271/207
4,822,016 * 4/1989 Sakuuchi et al. ..... 270/58.18
5,033,731 * 7/1991 Looney ..... 271/207
5,328,169 * 7/1994 Mandel ..... 271/298
5,347,350 * 9/1994 Nakahata et al. ..... 271/9.03
5,551,686 * 9/1996 Sanchez et al. ..... 270/58.18
5,742,890 * 4/1998 Kato et al. ..... 271/292
5,810,352 * 9/1998 Kobayashi et al. ..... 271/288
5,823,529 * 10/1998 Mandel et al. ..... 271/296

FOREIGN PATENT DOCUMENTS 63-147771 6/1988 (JP) .
2-310255 12/1990 (JP) .

* cited by examiner

*Primary Examiner*—H. Grant Skaggs
(74) *Attorney, Agent, or Firm*—Pitney, Hardin, Kipp & Szuch LLP

(57) ABSTRACT

An automatically sheet sorting device has multistage trays for storing sheets fed from a copying machine or the like, which each incorporate a sheet detecting mechanism including a sheet-empty detection lever of sheet-empty detecting means for detecting the sheet existing on the tray, and a sheet-full detection lever of sheet-full detecting means for detecting the sheets reaching a prescribed storage limit. The individual operable sheet-empty detection lever and sheet-full detection lever can be assembled in the tray compactly. A sheet-empty actuating member connected to the sheet-empty detection lever for actuating a sheet-empty switch and a sheet-empty actuating member connected to the sheet-full detection lever for actuating a sheet-full switch are of electrically non-contacting mechanism, thus to enable the tray to he readily detached from and attached to the device without any troublesome work of establishing an electrical connection or disconnection of electric elements between the tray and the device.

24 Claims, 11 Drawing Sheets

Rs
b(m)
52
51
64
Sb
65b
65a
60
62
61
S(m+1)
54
51
Rs
65a
45
61
b(m+1)
21
51
64
63
62
20
65a
61

21
53
54
65
61
20
Sb
45
Rs
Hx
20
21
Sb
53
52
51
63
61
65a

SHEET SORTING DEVICE

BACKGROUND OF THE INVENTION

1. Field of the Invention

This invention relates to a device for sorting and storing sheets fed from an image forming device such as a copying machine, and more particularly to a sheet sorting device having sheet storing trays each incorporating therein sheet-empty detecting means and sheet-full detecting means in a rational manner.

2. Description of the Prior Art

An image forming device such as a copying machine, printer, facsimile and various type of printing machines is often used with a sheet sorting device for automatically sorting or distributing sheets successively fed from the image forming device to produce sheaves of sheets. The sheet sorting device is ordinarily attached to the side of the image forming device and provided with a plurality of sheet storing trays closely superposed vertically over one another, so that the sheets discharged from the image forming device are sent into the trays in order.

The sheet sorting device of this kind generally necessitates one or more sheet sensors for detecting a sheet or sheets on the tray and checking whether or not the tray is filled with sheets.

One example of a prior art sheet sorting device is disclosed as a paper discharge device in Japanese Patent Application Public Disclosure No. HEI 2-310255(A). As schematically illustrated in FIG. 1A and FIG. 1B, this conventional sheet sorting device is also provided with multistage trays 1*a*,1*b* . . . vertically arranged, each having a sheet sensor 2 for detecting a sheet S or sheets Sb introduced from an image forming device into a sheet storing space Rs defined on the tray through sheet transporting means 3.

The sheet sensor 2 comprises a substantially L-shaped sheet detecting lever 2*a* supported on the tray rotatably about an axis a1, an actuating member 2*b* rotatable in concert with the lever 2*a,* and a pair of sheet-empty switch Sw1 and sheet-full switch Sw2, which switches execute switching actions in accordance with the rotation of the actuating member 2*b*.

For example, when no sheet exists on the lower tray 1*b* under the tray 1*a* having the subject lever 2*a,* the sheet detecting lever 2*a* on the upper tray 1*a* falls into an opening formed in the lower tray 1*b,* as indicated by the solid line in FIG. 1A, to keep the switches Sw1 and Sw2 in their OFF state. When one or more sheets are fed onto the tray 1*b,* the sheet detecting lever 2*a* is raised on the tray, as indicated by the solid line in FIG. 1B, to bring the sheet-empty switch Sw1 to its ON state, thus recognizing that one or more sheets exist on the tray.

When the lower tray 1*b* is filled with the sheets Sb, the lever 2*a* is raised to its upper limit position as indicated by the dot-dash line in FIG. 1B, consequently to bring the sheet-full switch Sw2 to its ON state. As a result the sheet-full state in which the lower tray becomes full of sheets can be realized by using the sheet-full switch Sw2 mounted on the upper tray 1*a*.

Thus, the sheet sensor 2 mounted on the specified tray in the conventional sheet sorting device serves to check as to whether any sheet exists on the specified tray and detect the sheet storage limit of the lower tray.

As the sheet detecting lever 2*a* of the sheet sensor 27 in the conventional device as noted above extends from the upper tray to the lower tray across the sheet storing space Rs, it cannot be made small in size is long as the sheet storing space Rs defined between the upper and lower trays is not narrowed, resulting in a large overall size of the sheet detecting system in the prior art device. In addition to the disadvantage, the free end arm of the L-shaped lever 2*a* cannot be made long, because the tip of the free end arm collides with the lowermost of the sheets stacked on the tray when the sheets on the tray is increased to move the lever 2*a* upward. As a result, in the event that a sheaf of sheets, which is once taken out of the sheet storing space Rs, is again inserted intentionally or accidentally into the sheet storing space Rs as indicated by the dotted arrow in FIG. 1B, there is a disadvantageous possibility of causing the sheets to be caught by the lever, or breaking the lever.

The latest sheet sorting device has a tendency to increase the number of the trays for heightening the efficiency of handling the sheets, but inversely, it is desired to be made compact and simple in structure. However, the conventional sheet sorting device could not be made small due to the sheet sensing system which is difficult to miniaturize by the reasons mentioned above.

Furthermore, there is a necessity of detaching one or more trays from the sheet sorting device in use. However, if any tray is detached, the sheets fed onto the lower tray do not reach the sheet detecting lever 2*a* mounted on the upper tray, resulting in malfunction of the sheet sensing system. That is, the conventional sheet sorting device cannot be used practically in the state of taking the tray out.

In addition, in the conventional sheet sorting device as mentioned above, electric elements including the switches Sw1 and Sw2 are secured on each tray along with the sheet detecting lever 2*a* and actuating member 2*b*. Therefore, when the tray is detached from and attached to the sheet sorting device, the work of establishing an electrical connection a disconnection between the electric elements mounted in the tray and the sheet sorting device is required. This turns out to be a very troublesome chore.

OBJECT OF THE INVENTION

An object of the present invention is to provide a sheet sorting device suitably applicable to various types of image forming devices such as a copying machine and printer, which is capable of automatically storing or sorting in order one or more sheets successively fed from the image forming device with high efficiency.

Another object of the invention is to provide a sheet sorting device having multistage trays each incorporating a sheet-empty detecting system and a sheet-full detecting system which are arranged in a rational manner so as to be stably and reliably operated.

Still another object of the invention is to provide a sheet sorting device having a structure capable of miniaturizing the sheet-empty detecting system and the sheet-full detecting system, consequently to enable the device to be made small and simple in structure.

Yet another object of the invention is to provide a sheet sorting device having the trays each having a sheet-empty sensor capable of fulfilling its sensing function even if the lower tray under the tray incorporating the sheet-empty sensor is detached.

A further object of the invention is to provide a sheet sorting device having trays capable of being easily attached to and detached from the device without carrying out troublesome work of establishing an electrical connection or disconnection of electric elements between the tray and the device.

SUMMARY OF THE INVENTION

To attain the objects described above according to the present invention, there is provided a sheet sorting device comprising trays for storing one or more sheets, sheet-empty detecting means incorporated in at least one of the trays for detecting the sheet existing on the tray, and sheet-full detecting means incorporated in at least one of the trays for detecting the sheets with which the lower tray is filled.

The trays are vertically arranged as spaced to define a sheet storing space between the vertically adjoining trays, in which the sheet storage limit is prescribed.

The sheets are successively fed from an image forming device such as a copying machine into the sheet storing space defined on the lower tray. When the sheets fed onto the lower tray are piled up to the prescribed sheet storage limit, the sheet-full detecting means incorporated in the upper tray is operated, thereby to recognize the sheet-full state of the lower tray. When any sheet exists on the tray, the sheet-empty detecting means incorporated in the tray is operated.

The sheet-empty detecting means includes a sheet-empty detection lever supported on the tray detachable from a device body of the sheet sorting device, a sheet-empty actuating member connected to the sheet-empty detection lever, and a sheet-empty switch secured on the device body and being opposite to the sheet-empty actuating member so as to be actuated by the sheet-empty actuating member.

The sheet-full detecting means includes a sheet-full detection lever supported on the tray detachable from a device body of the sheet sorting device, a sheet-full actuating member connected to the sheet-full detection lever, and a sheet-full switch secured on the device body and being opposite to the sheet-full actuating member so as to be actuated by the sheet-full actuating member.

As the sheet-empty switch and the sheet-full switch are both secured on the device body and separated from the sheet-empty actuating member and the sheet-full actuating member, respectively, the tray can easily be detached from and attached to the device body without carrying out any troublesome work of establishing an electrical connection or disconnection between the tray and the device body.

Since the sheet-empty detecting means and sheet-empty detecting means are independently mounted on the tray, they can be miniaturized individually, consequently to enable the whole device to be made compact.

Other and further objects of this invention will become obvious upon an understanding of the illustrative embodiments about to be described or will be indicated in the appended claims, and various advantages not referred to herein will occur to one skilled in the art upon employment of the invention in practice.

DESCRIPTION OF THE PREFERRED EMBODIMENTS

The sheet sorting device according to this invention has a function of storing and automatically sorting or distributing sheets successively fed from an image forming device as well as a function of reliably recognizing the existence of the sheets and the state in which the sorting device is filled with the sheets given from the image forming device by use of sheet detecting means incorporated in the sorting device in a rational manner. The sheet sorting device of the invention is applicable to the image forming device of any type such as a copying machine, printer and facsimile, but does not contemplate imposing any limitation on its usage.

Figure 1A:
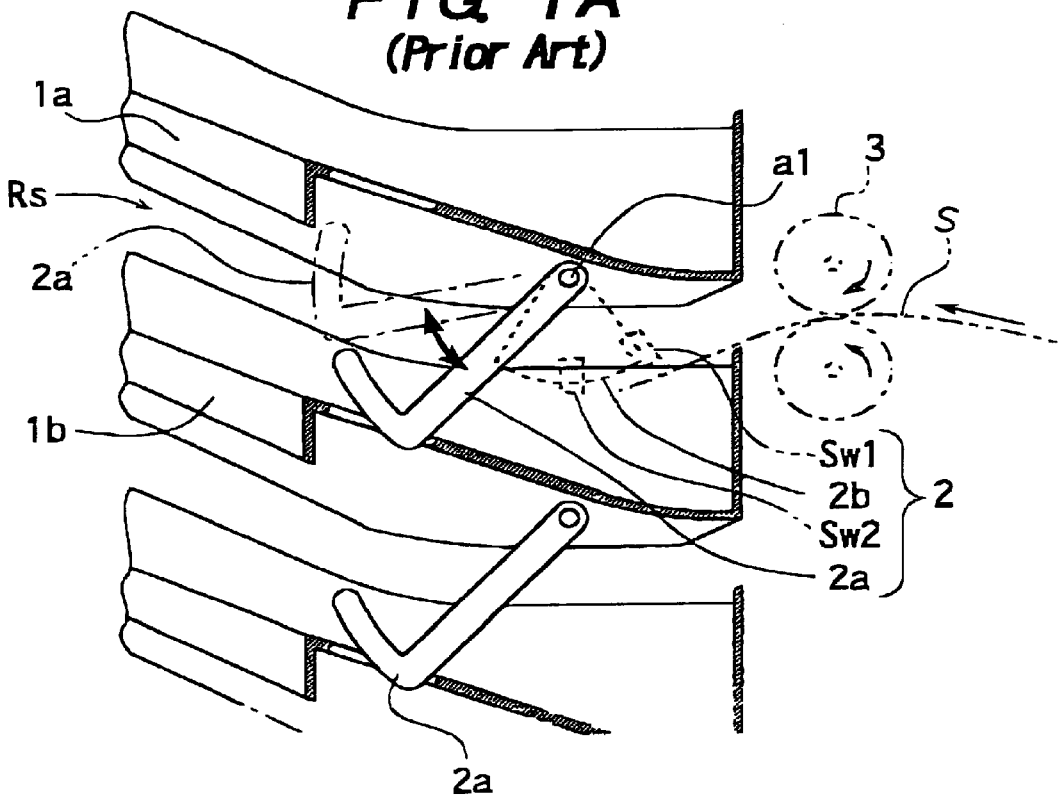
FIG. 1A (Prior Art)
FIG. 1A and FIG. 1B are schematic diagrams showing sheet sensors mounted on trays of a prior art sheet sorting device.
Figure 1B:
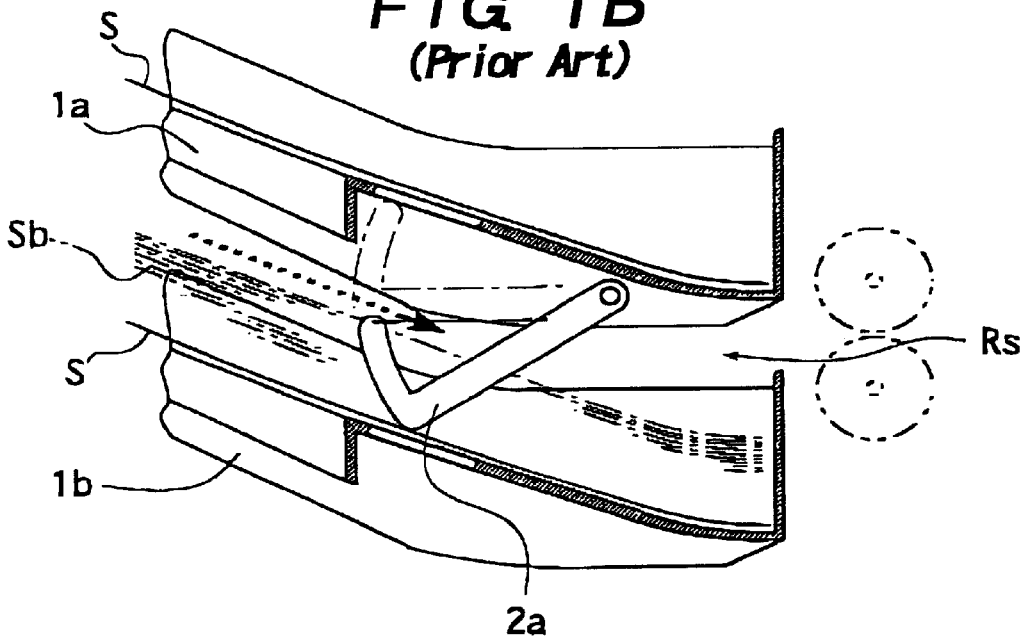
FIG. 1B (Prior Art)
Figure 2:
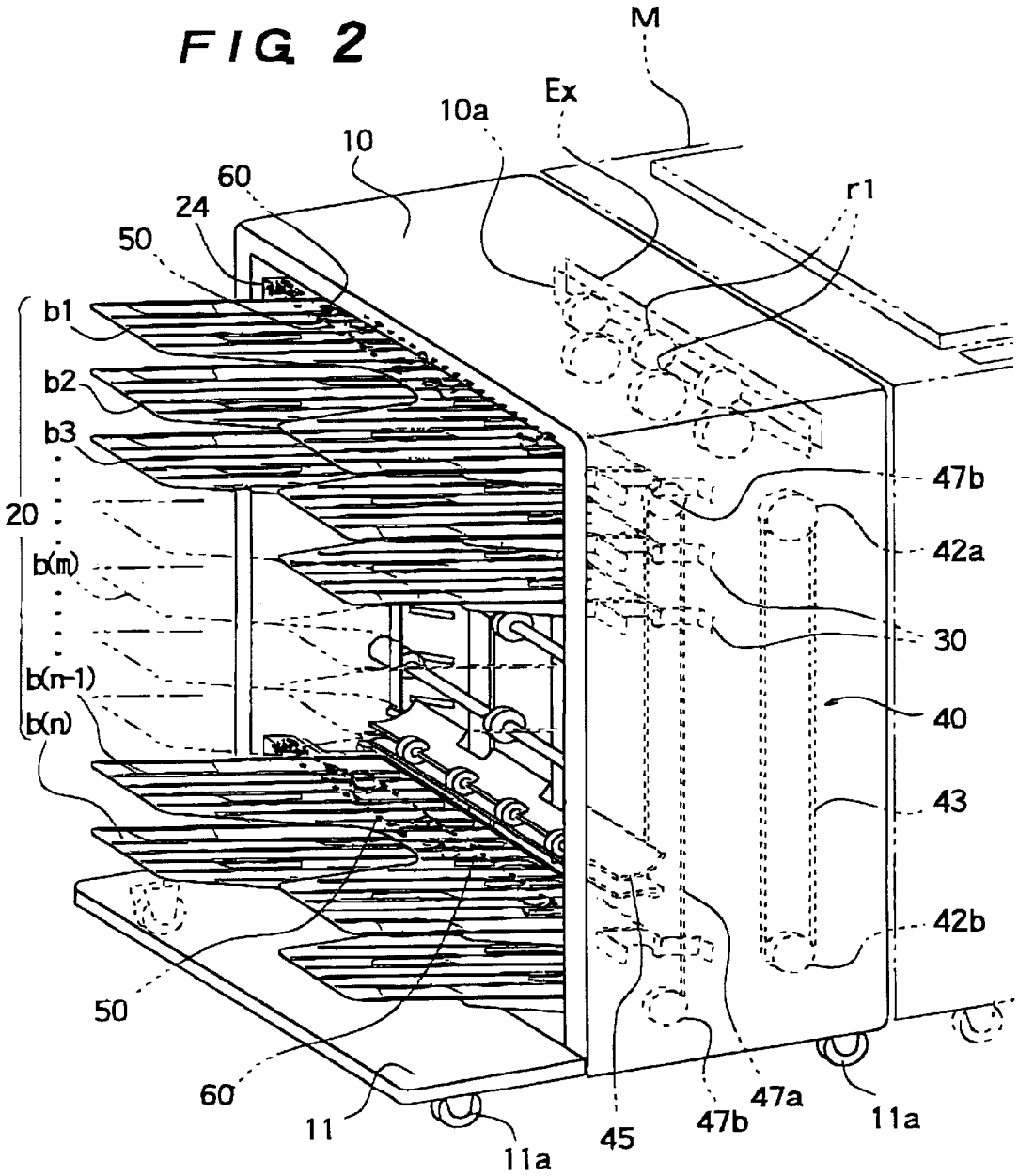
FIG. 2 is a perspective view schematically showing one embodiment of a sheet sorting device according to this invention.
Figure 3:
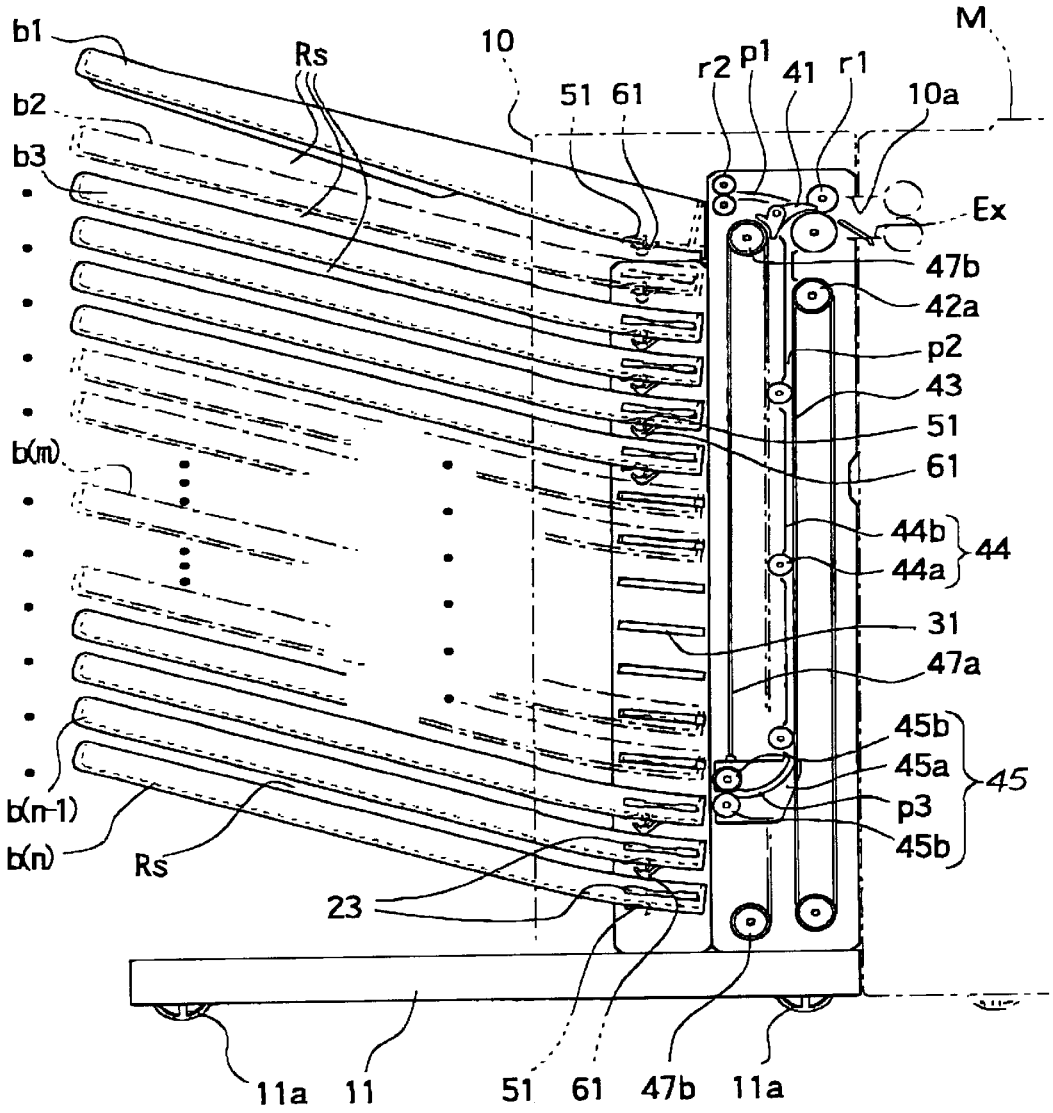
FIG. 3 is a schematic side view of the device of FIG. 2.
Figure 4:
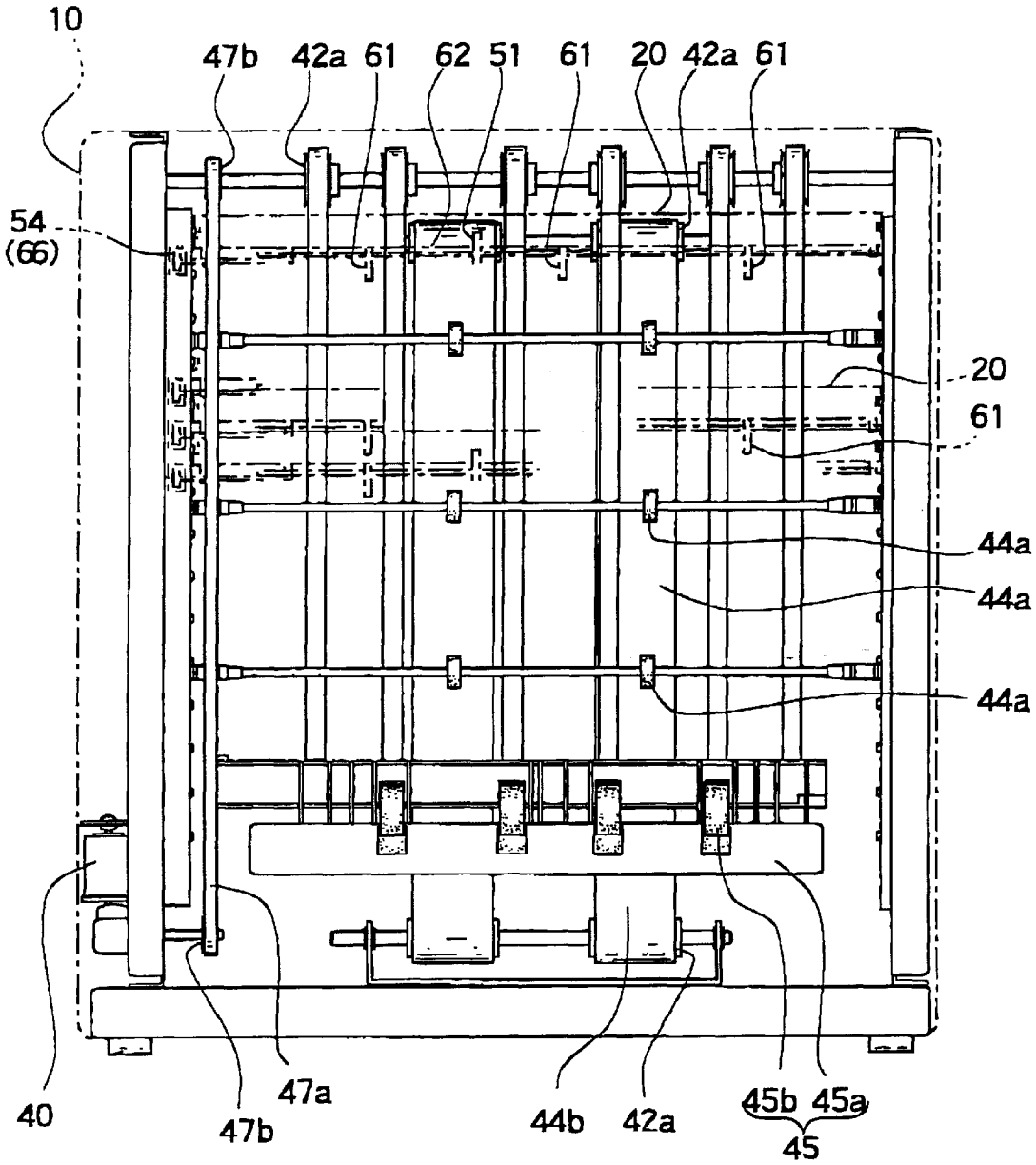
FIG. 4 is a schematic front view of the device of FIG. 2.

An embodiment in which the sheet sorting device of the invention is applied to a copying machine M is illustrated in FIGS. 2 and 3 by way of example. The sheet sorting device is fundamentally coupled to the side of the copying machine M so as to have a sheet entrance port 10*a* in a housing 10 opposed to a sheet discharge port Ex of the copying machine M.

The housing (device body) 10 has a base 11 with moving means 11*a* such as wheel casters, means 30 for supporting sheet storing trays 20 (b1,b2, . . . ,bm, . . . ,bn−1,bn) arranged in juxtaposition as spaced to define sheet storing spaces Rs between the adjoining trays, and means 40 for transporting sheets S fed successively from the copying machine M to the respective trays 20 in order. The trays in this embodiment are arranged vertically as superposed one on another.

The sheet sorting device of the invention further comprises sheet-empty detecting means 50 for recognizing the existence of the sheet or sheets on the tray, and sheet-full detecting means 60 for realizing the sheet-full state in which the lower tray is filled with the sheets.

Figure 5:
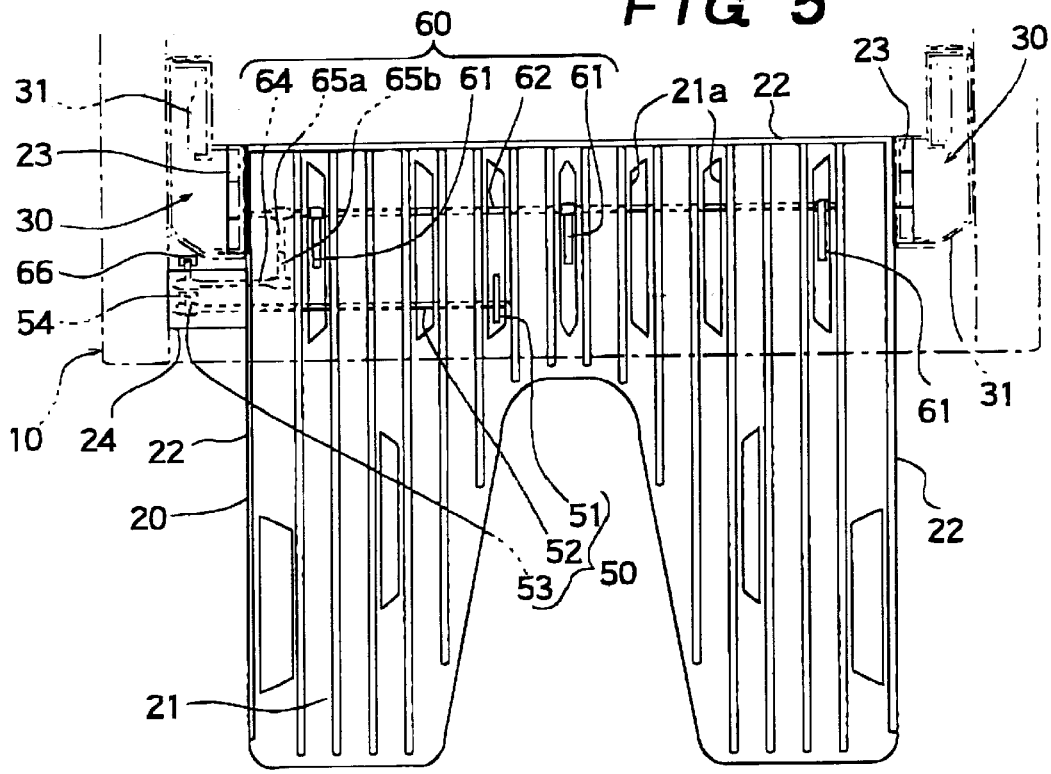
FIG. 5 is a schematic plan view showing a sheet storing tray in the device of this invention.
Figure 6:
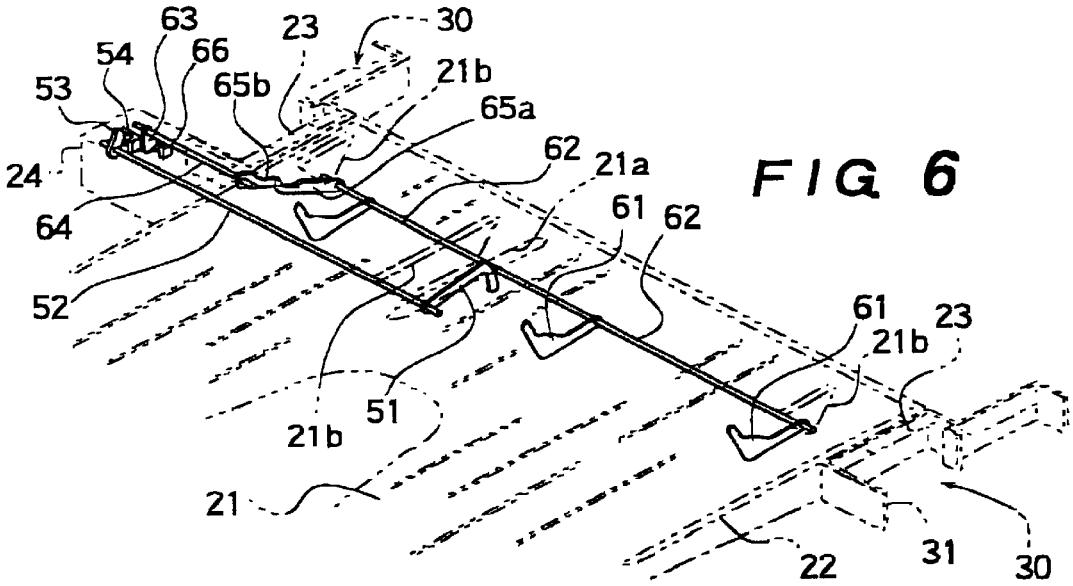
FIG. 6 is a schematic perspective view showing sheet detecting means in the device of this invention.

The tray 20 has a substantially U-shaped sheet support surface member 21 as shown in FIG. 5, which has four sides confined by sheet holding walls 22, and engaging means 23 to be joined to tray retaining members 31 of the tray supporting means 30 fixed on the device body (housing) 10 so as to detachably secure the tray on the sheet sorting device. The engagement mechanism formed of the engaging means 23 of the tray and the tray retaining members 31 on the device body 10 enables the tray to be steadily attached to and detached from the sheet sorting device with ease, but should not be understood as being limited to the structure illustrated.

The trays 20 are secured on the device body 10 in parallel to one another and inclined with their free ends (left ends in FIG. 3) directed slightly upwards, so that the sheets stacked on the tray slide down by their own weight toward the rear end (right side in FIG. 3) of the tray along the sheet support surface member 21. As a result, the rear ends of the sheets stacked on the tray are trued up.

The sheet-empty detecting means 50 comprises a substantially L-shaped sheet-empty detection lever 51 disposed beneath the sheet support surface member 21 of the tray 20, a rotational shaft 52 rockingly supporting the sheet-empty detection lever 51, which extends widthward over the sheet support surface member 21, a sheet-empty actuating member 53 disposed on the outer end portion of the rotational shaft 52, and a sheet-empty switch 54 fixed on the device body 10, which is opposite to the sheet-empty actuating member 53 so as to perform switching actions in accordance with the rotation of the sheet-empty actuating member 53.

Figure 8:
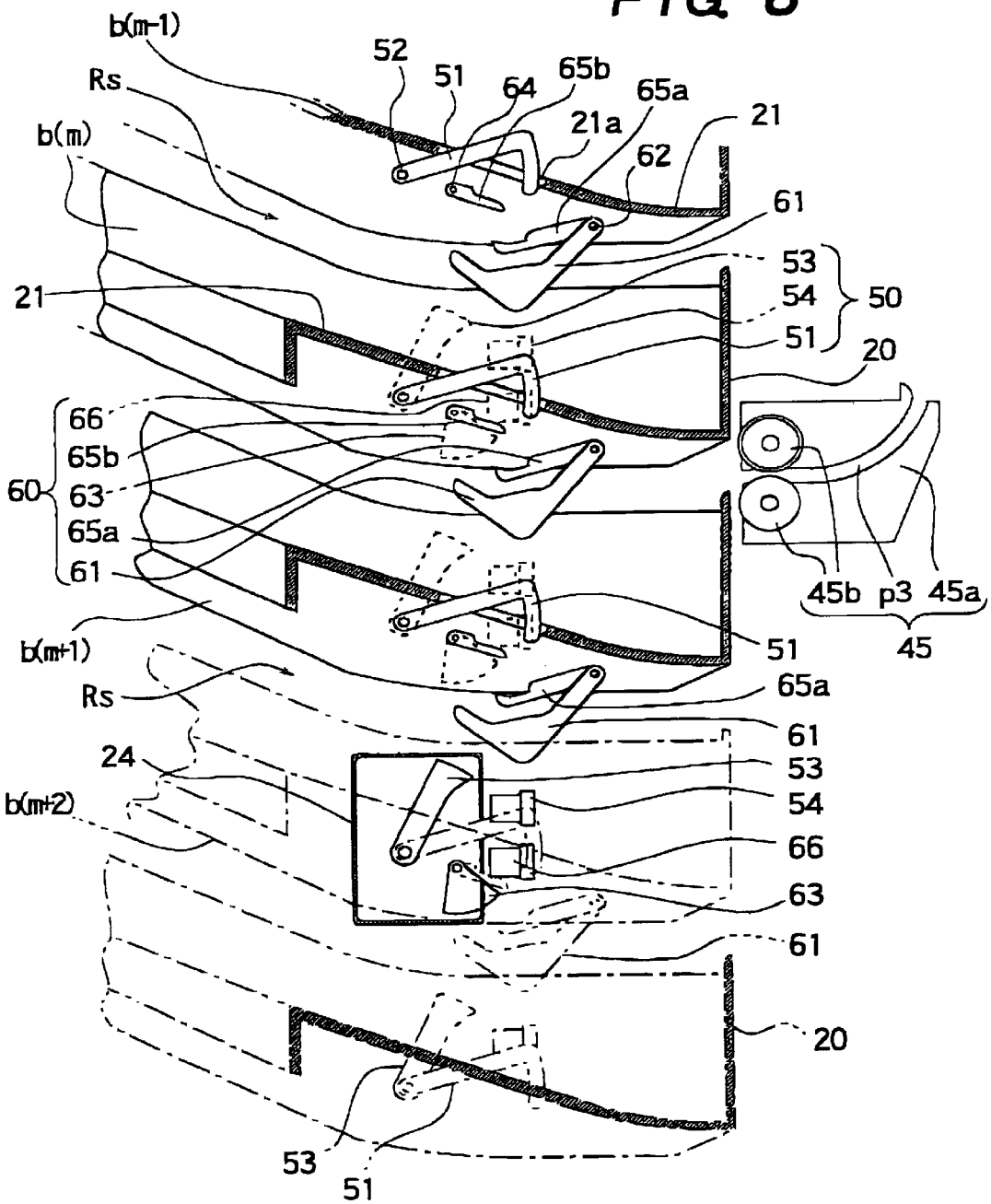
FIG. 8 is an explanatory diagram illustrative of the sheet detecting means of the invention in the sheet-empty state.

The sheet-empty detection lever 51 is constantly urged by a resilient means such as a spring (not shown) so as to partially project upward through one of openings 21*a* which are bored in the sheet support surface member 21 to lessen the weight of the tray, are typically shown in FIG. 8.

Reinforcing ribs 21*b* formed on the lower surface of the sheet support surface member 21 are used as bearing members for rotatably holding the rotational shaft 52.

Figure 9:
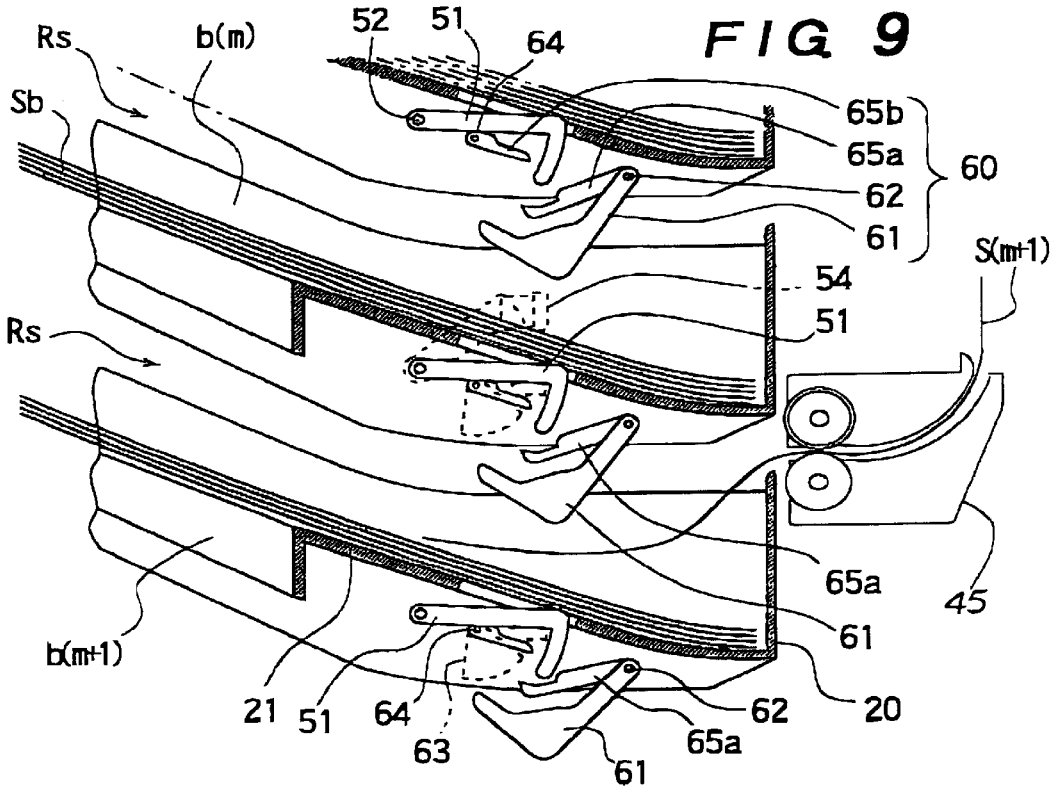
FIG. 9 is an explanatory diagram illustrative of the sheet detecting means of the invention when sheets exist on the tray.
Figure 10:
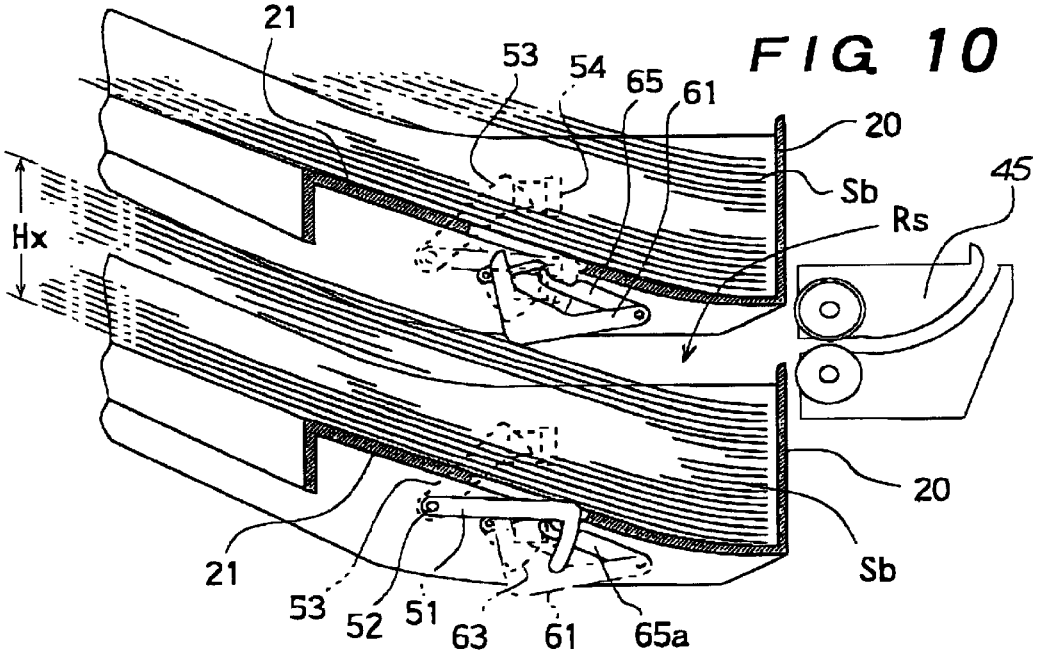
FIG. 10 is an explanatory diagram illustrative of the sheet detecting means of the invention in the sheet-full state.

In this embodiment, the sheet-empty actuating member 53 and the sheet-empty switch 54 are formed of an optoelectro switching structure composed of a photo-interrupter plate and a photo sensor. For instance, as seen in FIG. 8, the sheet-empty actuating member (photo-interrupter plate) 53 and the sheet-empty switch (photo sensor) 54 are located, so that the sheet-empty switch 54 is kept in its OFF state when no sheet exists on the sheet support surface member 21 of the tray 20 to bring the sheet-empty actuating member 53 into its upward protruding state as shown in FIG. 8, and the sheet-empty switch 54 is turned ON when one or more sheets are stacked on the sheet support surface member 21 to depress the lever 51, thus bringing the sheet-empty actuating member 53 into its lower position as illustrated in FIG. 9 and FIG. 10. As a countermeasure, the sheet-empty switch 54 may be brought into its ON state when no sheet exists on the tray, and into its OFF state when one or more sheets are stacked on the tray.

Since the switching structure used in this embodiment is of a non-contacting type, the tray 20 can on easily be attached to and detached from the device body 10 without need to establish an electrical connection or disconnection between the tray and the device body.

In FIGS. 8 and 10, the sheet-empty detection lever 51 is illustrated on an enlarged scale as compared with the size of the tray in an easily understandable manner, but practically, it may be made remarkably small.

The sheet-full detecting means 60 comprises one or more substantially L-shaped sheet-full detection levers 61 disposed beneath the sheet support surface member 21 of the tray 20, a rotational shaft 62 rockingly supporting the sheet-full detection levers 61, a sheet-full actuating member 63 disposed on one end portion of a connection shaft 64, transmission means 65*a* and 65*b* for transmitting the rotation of the rotational shaft 62 to the connection shaft 64, and a sheet-full switch 66 fixed on the device body 10, which is opposite to the sheet-full actuating member 63 so as to execute switching actions in accordance with the rotation of the sheet-full actuating member 63.

Figure 7:
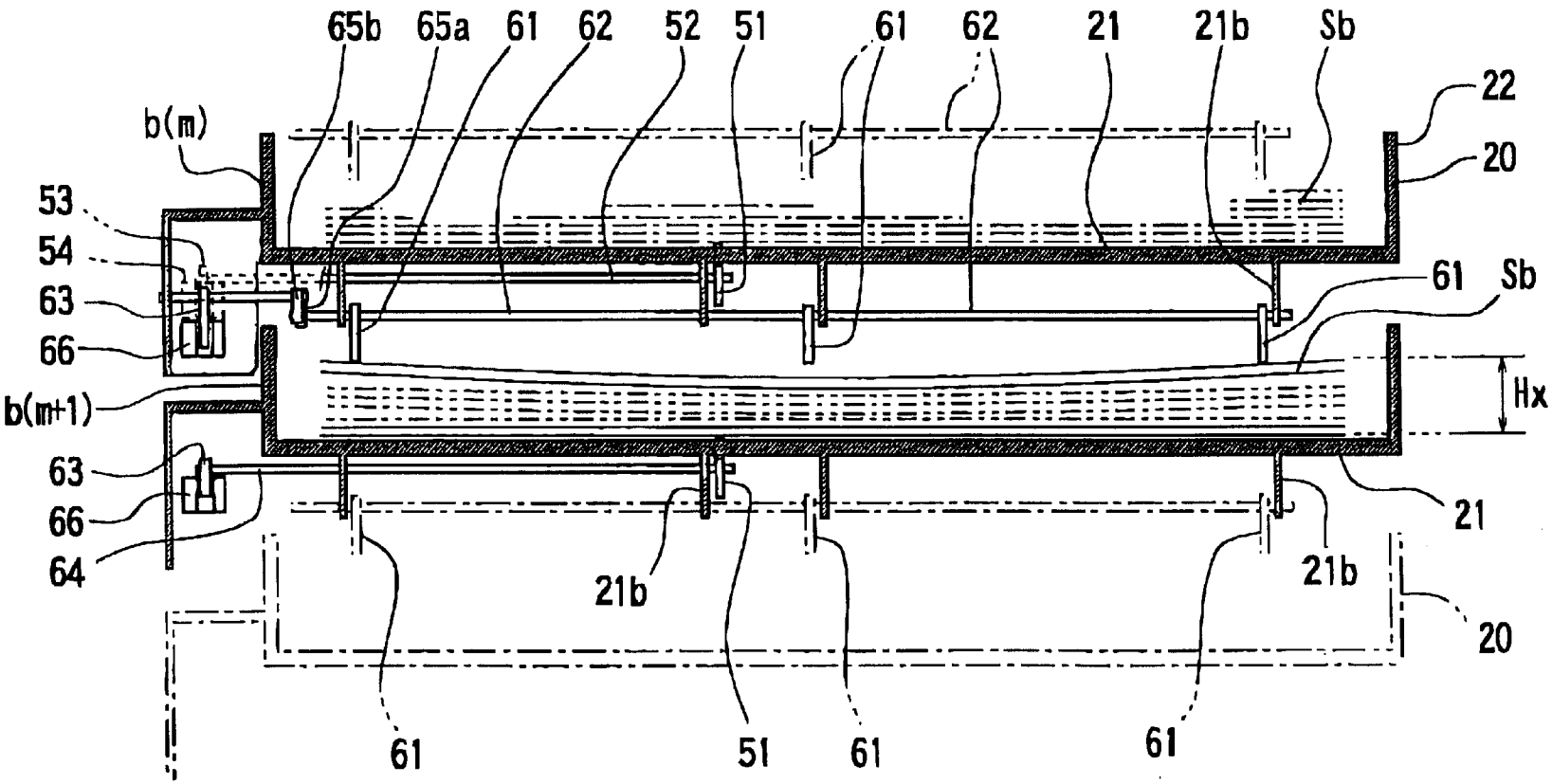
FIG. 7 is a sectional side view of the tray in the device of this invention

The sheet-full detection levers 61 in this embodiment are located at the central position and the both end positions of the rotational shaft 62, as shown in FIG. 7, but the number of the levers 61 and the position at which the lever is located are by no means limited thereto. The lever 61 is rockingly supported by the rotational shaft 62 with its free end dangling, so as to be operated when the amount of the sheets stacked on the lower tray is near the prescribed storage limit (maximum number of sheets the tray is allowed to store) Hx to which the sheets are permitted to be accommodated in the tray.

Since more than one sheet-full detection lever 61 are arranged widthward as separated from one another, the prescribed storage limit Hx can be surely discerned with accuracy even if the sheaf of sheets Sb on the tray 20 is curved with its central part recessed as shown in FIG. 7 by way of example.

The rotational shaft 62 supporting the sheet-full detecting levers is also held rotatably by the reinforcing ribs 21*b* formed on the lower surface of the sheet support surface member 21.

The sheet-full actuating member 63 and the sheet-full switch 66 also constitute an optoelectro switching structure composed of a photo-interrupter plate and a photo sensor.

The sheet-full actuating member (photo-interrupter plate) 63 and the sheet-full switch photo sensor) 66 are located in the following manner. The sheet-full switch 66 mounted on the m-numbered tray b(m) is not operated to be kept in its OFF state when less than the maximum number (Hx) of sheets the lower tray b(m+1) is allowed to store, as shown in FIG. 8 and FIG. 9 as one example. When the number of sheets stacked on the lower tray b(m+1) approaches the maximum number Hx, the sheet-full switch 66 is actuated by the sheaf of sheets and turned ON, as shown in FIG. 10.

In the reverse manner to the foregoing, the sheet-full switch 64 on the tray b(m) may of course be brought into its ON state when less than the maximum number of sheets exists on the lower tray b(m+1), and into its OFF state when the tray b(m+1) is nearly full of sheets.

Since the sheet-full actuating member 63 mounted on the tray and the sheet-full switch 66 secured on the device body 10 are of a non-contacting type switching mechanism, attachment and detachment of the tray 20 relative to the device body 10 can readily be carried out without need to establish an electrical connection or disconnection between the tray and the device body.

Similarly to the sheet-empty detection lever 51, the sheet-full detection lever 61 is illustrated on an enlarged scale as compared with the size of the tray in FIG. 8 through FIG. 10 to facilitate undemanding of these mechanisms, but these levers 51 and 61 can be made remarkably small practically. Thus, the sheet-empty detection lever 51 and sheet-full detection lever 61 can be miniaturized, so that the structure of the tray can be freely decided from the standpoint of design. Thus, the small-sized sheet detecting mechanism formed of the levers 51 and 61 and other moving parts assembled in the tray does not form any obstruction to forward the sheets to be handled.

In passing, the lowermost tray (n-numbered tray b(n) in FIG. 3) has not necessarily need for the sheet-full detecting means 60, but the sheet-full detecting means 60 may preferably be provided on all the trays for the reason that the trays used in the sorting device can he exchanged for one another Reference numeral 24 denotes a cover disposed on the side of the tray for guarding the sheet-empty actuating member 53, sheet-full actuating member 63 and so on.

The sheet transporting means 40 includes a first sheet passage p1 extending from the sheet entrance port 10*a* confronting the sheet discharge port Ex of the copying machine M to the uppermost first tray b1, a secondary sheet passage p2 leading to the lower trays b2, . . . ,bm, . . . ,bn−1,bn, and a change-over member 41 disposed at a diverging point of the passages p1 and p2. The sheet fed from the copying machine through a pair of sheet feeding rollers r1 is selectively sent into either of the passages p1 and p2 by controlling the change-over member 41. The sheet introduced into the passage p1 is discharged through a pair of discharge rollers R2.

The secondary sheet passage p2 is defined between a sheet feeding endless belt 43, which is stretched between pulleys 42*a* and 42*b,* and guide means including guide rollers 44*a* and guide members 44*b*. The sheet introduced into the secondary sheet passage p2 is moved downward along the passage p2 by driving the endless belt 43, and sent into one of the sheet storing spaces Rs defined on the lower trays b2, . . . ,b(m), . . . ,b(n−1),b(n) by use of an indexer 45.

The indexer 45 comprises guide members 45*a* between which a sheet leading passage p3 is formed, and guide rollers 45*b* for forwarding the sheet along the passage p3. When the sheet is introduced into the secondary passage p2, the indexer 54 moves to and stops at the specified tray b(m), thereby to send the sheet into the sheet storing space Rs defined the specified tray through the passages p3.

The indexer 45 is moved vertically along the secondary sheet passage p2 by controlling a drive mechanism including a motor 46 through the medium of power transmission means such as a lifting belt 47*a* supported by pulleys 47*b*.

Next, the sheet distributing operation of the sheet sorting device of this embodiment will be explained with reference to FIG. 11A through FIG. 11D.

Figure 11A:
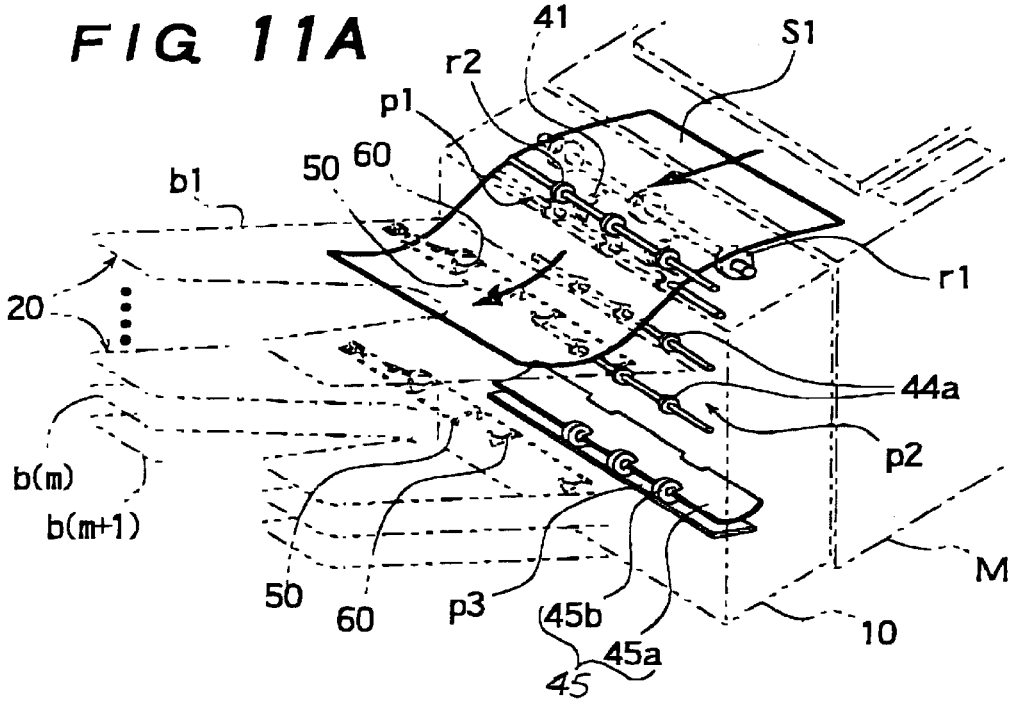
FIG. 11A through FIG. 11D are schematic diagrams showing a process in which a sheet is introduced into the sheet storing trays.

When the first sheet S1 is fed from the copying machine M at the outset, the change-over member 41 is operated to open the first sheet passage p1, consequently to send the sheet S1 to the uppermost first tray b1 through the passage p1 and the rollers r2, as shown in FIG. 11A.

In case of dealing with only one set of sheets, the change-over member 41 need not change and maintains the state of forwarding all the sheets successively fed from the copying machine to the first tray b1.

When obtaining two or more sets of sheets, the first ones of the same page sheets are introduced into the uppermost first tray b1 through the passage p1, and the second and following ones of the same page sheets are respectively sent into the second and following trays b2, b3, . . . by operating the indexer 40. That is to say, m-numbered sheet S(m) of a certain page is introduced into m-numbered tray b(m).

Figure 11B:
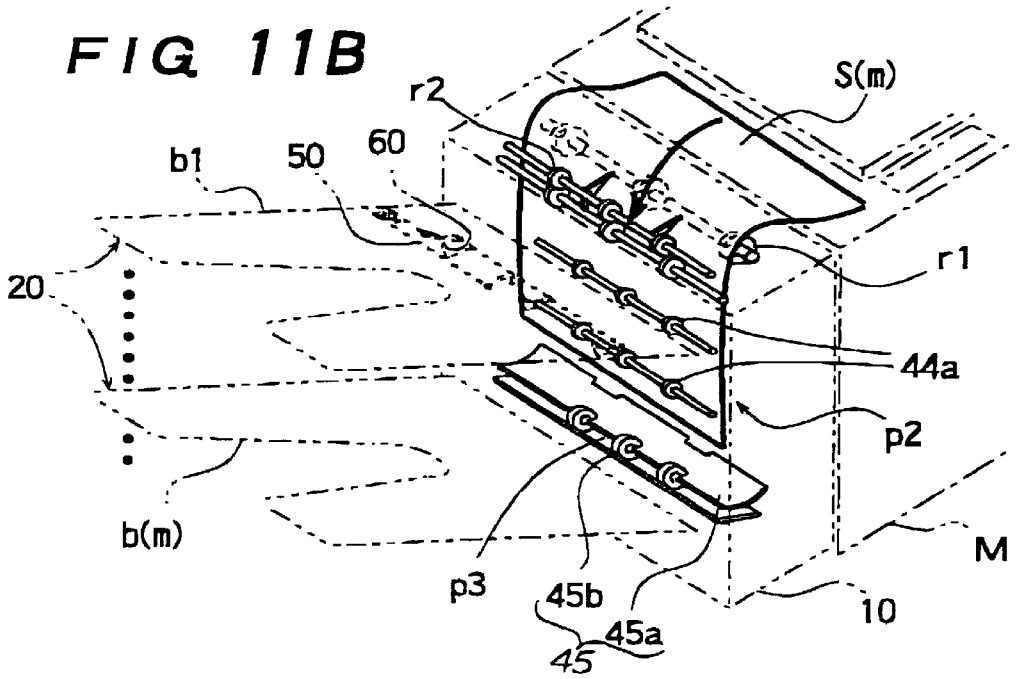
Figure 11C:
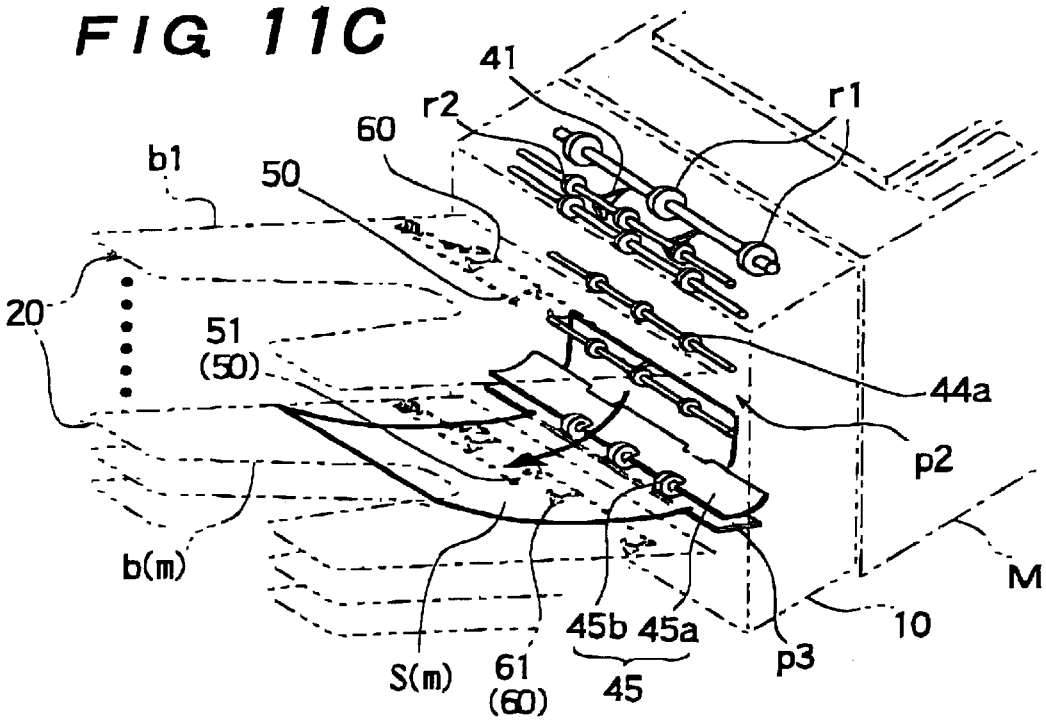
Figure 11D:
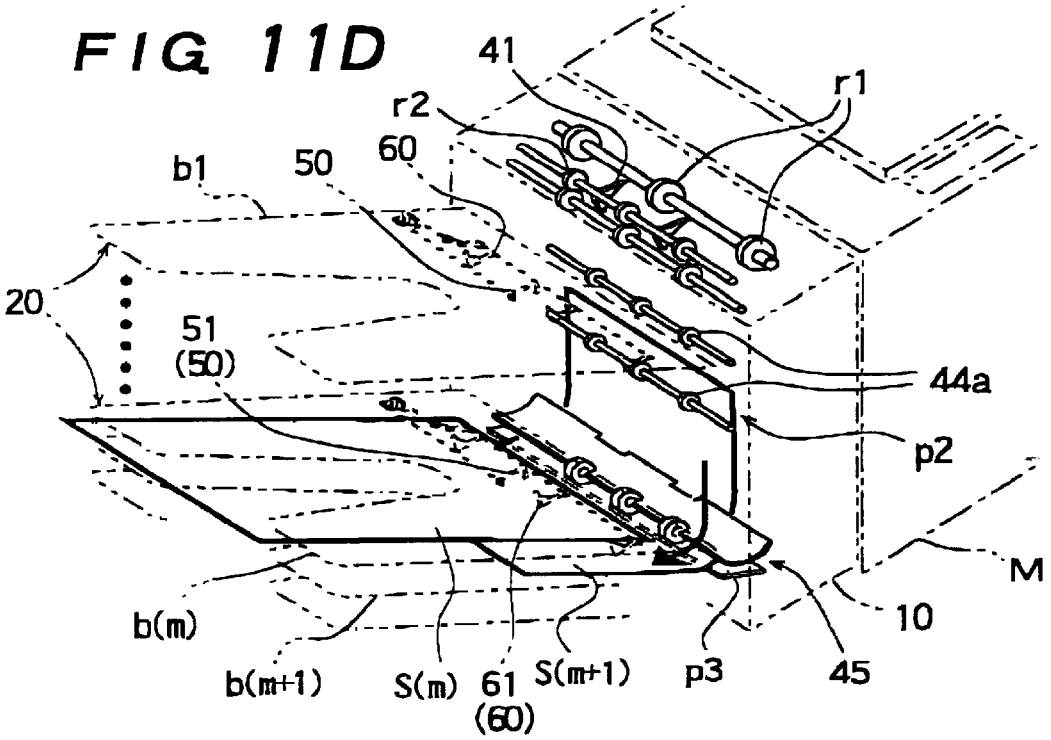

To be more specific, when the m'th sheet S(m) is introduced from the copying machine M into the secondary sheet passage p2, the indexer 40 is positioned confronting the m'th tray b(m) as shown in FIG. 11B, and then, the m'th sheet S(m) is sent into the sheet storing space Rs on the m'th tray b(m), as shown in FIG. 11C. When the next m+1'th sheet S(m+1) is fed from the copying machine M, the indexer 40 is moved to the position confronting the m+1'th tray b(m+1), consequently to introduce the m+1'th sheet S(m+1) into the sheet storing space Rs on the m+1'th tray b(m+1) as shown in FIG. 11D.

The following sheets successively fed from the copying machine M are sent into the relevant trays in order in the same manner as above.

When sending one or more sheets into the specified tray, the sheet-empty detecting mesas 50 is activated in the manner stated above, consequently to cause the sheet sorting device to manifest the essence of the sheet on the specified tray. When the specified tray is filled with sheets, namely, the sheets stacked on the tray reach the prescribed storage limit Hx, the sheet-full detecting means 60 is operated to cause the sheet sorting device to manifest the sheet-full state and come to a standstill.

In the foregoing embodiment, the interval between the vertically adjoining trays, i.e. the size of the sheet storing space Rs, can be enlarged by removing one or more trays, but is not continuously variable.

Figure 12:
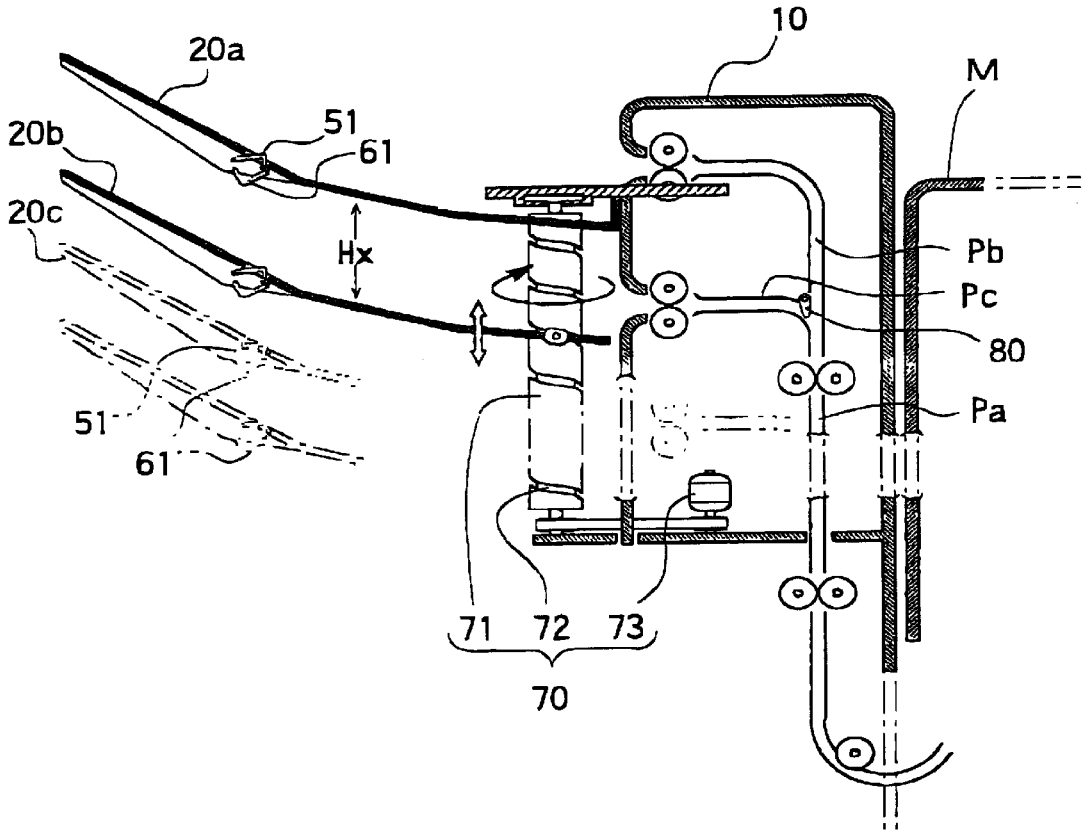
FIG. 12 is a schematic side view showing another embodiment of the invention.

A tray moving mechanism as shown in FIG. 12 makes it possible to continuously change the size of the sheet storing space Rs defined between the vertically adjoining trays.

In this modified embodiment, the uppermost first tray 20*a* is stationary, and the lower tray 20*b* an movable vertically by use of tray lifting means 70. The tray lifting means 70 comprises a lead screw member 71 with a cam groove 72, and reversible driving means 73 for rotating the lead screw member 71. By rotating the lead screw member 71, the movable tray is moved vertically along the cam groove 72.

Similarly to the foregoing embodiment, the trays in this embodiment is provided with the sheet-empty detection lever 51 and the sheet-full detection lever 61. With the sheet-empty detection lever 51, the existence of the sheet on the tray can be recognized, and the sheet-full state in which the tray is filled with sheets can be realized with the sheet-full detection lever 61.

First, the sheet to be sent to the stationary uppermost tray 20*a* advances through passages Pa and Pb, and the sheet to be sent to the lower tray 20*b* advances through the passage Pa and passage Pc. When sending the sheet to the tray 20*a,* a change-over member 80*a* is operated to allow the passage Pa to communicate with the passage Pb, and when sending the sheet to the tray 20*b,* the change-over member 80*a* is operated to allow the passage Pa to communicate with the passage Pc.

When requiring more trays to produce a plurality of sheaves of sheets, the desired number of movable trays may be disposed as aligned to the cam groove 72 as indicated by the imaginary line in FIG. 12.

According to the tray moving mechanism having the movable tray, the sheet storing space Rs can arbitrarily vary in accordance with the required number of sheets to be dealt with, the quality of the sheet such as sheet material and thickness, and other conditions.

As is apparent from the foregoing description, the sheet sorting device according to the present invention makes it possible to precisely discern whether one or more sheets exist on each tray, and whether the tray is full of sheets by use of the sheet-empty detecting means 50 and the sheet-full detecting means 60. Since the sheet-empty detection lever 51 of the sheet-empty detecting means 50 and the sheet-empty detection lever 61 of the sheet-full detecting means 60 can be miniaturized and assembled compactly in the tray, it is possible to effectively secure the sheet storing space on each tray, and make the entire sheet sorting device small in size.

Furthermore, since the sheet-empty actuating member 53 and sheet-full actuating member 63 which are mounted on the tray is separated from the respective counterpart switches 54 and 66 which are fixed on the device body 10, the tray can easily be removed from the device body without any troublesome work of establishing an electrical connection or disconnection of electric elements between the tray and the device.

As can be readily appreciated, it is possible to deviate from the above embodiments of the present invention and, as will be readily understood by those skilled in this art, the invention is capable of many modifications and improvements within the scope and spirit thereof. Accordingly, it will be understood that the invention is not to be limited by these specific embodiments, but only by the scope and spirit of the appended claims.

What is claimed is:

1. A sheet sorting device comprising trays for storing one or more sheets, said trays including an uppermost tray, one or more lower trays and a lowermost tray, sheet-empty detecting means and sheet full detecting means incorporated in each of said trays for detecting one or more sheets existing on each of said trays by detecting the sheets stacked on trays beneath said tray provided with said sheet-full detecting means when said sheets on said lower tray reach a prescribed storage limit, said sheet-full detecting means having a plurality of sheet detection members arranged widthward across the tray and separated from one another.

2. A sheet sorting device as claimed in claim 1, wherein said trays except for said lowermost tray are provided with said sheet-full detecting means.

3. A sheet sorting device as claimed in claim 1, wherein said sheet-empty detecting means includes a sheet-empty detection lever, a rotational shaft rockingly supporting said sheet-empty detection lever and rotatably disposed on said tray, a sheet-empty actuating member disposed on said rotational shaft, and a sheet-empty switch opposite to said sheet-empty actuating member to perform switching actions in accordance with rotation of said sheet-empty actuating member.

4. A sheet sorting device as claimed in claim 1, wherein said sheet-full detecting means includes one or more sheet-full detection levers, a rotational shaft rockingly supporting said sheet-full detection levers and rotatably disposed on said tray, a sheet-full actuating member connected to said rotational shaft, and a sheet-full switch opposite to said sheet-full actuating member to perform switching actions when said sheets on said tray reach a prescribed storage limit.

5. A sheet sorting device as claimed in claim 1, wherein said sheet-empty detecting means includes a sheet-empty detection lever, a rotational shaft rockingly supporting raid sheet-empty detection lever and rotatably disposed on said tray, a sheet-empty actuating member disposed on said rotational shaft, and a sheet-empty switch opposite to said sheet-empty actuating member to perform switching actions in accordance with rotation of said sheet-empty actuating member, and said sheet-full detecting means includes one or more sheet-full detection levers, a rotational shaft rockingly supporting said sheet-full detection levers and rotatably disposed on said tray, a sheet-full actuating member connected to said rotational shaft, and a sheet-full switch opposite to said sheet-full actuating member to perform switching actions when said sheets on said tray reach a prescribed storage limit.

6. A sheet sorting device comprising a device body, trays for storing one or more sheets, said trays including an uppermost tray, one or more lower trays and a lowermost tray, sheet-empty detecting means incorporated in each of said trays for detecting one or more sheets existing on each of said trays, and sheet-full detecting means incorporated in each of said uppermost and lower trays for detecting the sheets stacked on said lower trays and lowermost tray beneath said tray provided with said sheet-full detecting means when said sheets on said lower tray reach a prescribed storage limit, said sheet-full detecting means having a plurality of sheet detection members arranged widthward across the tray and separated from one another.

7. A sheet sorting device as claimed in claim 6, wherein said trays are detachably attached to said device body, said trays being adjacent to one another to form sheet storing spaces variable by detaching at least one of said trays from said device body.

8. A sheet sorting device as claimed in claim 6, wherein said trays are movable vertically, said trays being adjacent to one another to form sheet storing spaces variable by being moved vertically.

9. A sheet sorting device as claimed in claim 6, wherein said sheet-empty detecting means includes a sheet-empty detection lever, a rotational shaft rockingly supporting said sheet-empty detection lever and rotatably disposed on said tray, a sheet-empty actuating member disposed on said rotational shaft, and a sheet-empty switch opposite to said sheet-empty actuating member to perform switching actions in accordance with rotation of said sheet-empty member, and said sheet-full detecting means includes a plurality of sheet-full detection levers, a rotational shaft rockingly supporting said sheet-full detection levers and rotatably disposed on said tray, a sheet-full actuating member connected to said rotational shaft, and a sheet-full switch opposite to said sheet-full actuating member to perform switching actions when said sheets on said tray reach a prescribed storage limit.

10. A sheet sorting device as claimed in claim 9, wherein said sheet-empty actuating member and said sheet-empty switch are of a non-contact switching mechanism, and said sheet-full actuating member and said sheet-full switch are of a non-contact switching mechanism.

11. A sheet sorting devices as claimed in claim 10, wherein said sheet-empty switch and said sheet-full switch are fixed on said device body.

12. A sheet sorting device as claimed in claim 6, further comprising means for transporting the sheets introduced into said device to said trays in order.

13. A sheet sorting device as claimed in claim 12, further comprising and indexer for introducing the sheet into a specified one of said trays.

14. A sheet sorting device comprising trays each having a sheet support surface on which one or more sheets are stacked, said trays including an uppermost ray, one or more lower trays and a lowermost tray, sheet-empty detecting means incorporated in each of said uppermost and lower trays for detecting one or more sheets existing on said tray, said sheet-empty detecting means having sheet-empty detection lever rockingly supported by a rotational shaft rotatably mounted under said sheet support surface, and sheet-full detecting means incorporated in each of said trays for detecting the sheets stacked on a tray beneath said tray provided with said sheet-full detecting means when said sheets on said last mentioned tray reach a prescribed storage limit, said sheet-full detecting means having one or more sheet-full detection levers rockingly supported by a rotational shaft rotatably mounted under said sheet support surface.

15. A sheet sorting device as claimed in claim 14, wherein said sheet-empty detecting means includes a sheet-empty actuating member disposed on said rotational shaft, and a sheet-empty switch opposite to said sheet-empty actuating member for performing switching actions in accordance with rotation of said sheet-empty actuating member, and a sheet-full actuating member connected to said rotational shaft and a sheet-full switch opposite to said sheet-full actuating member for performing switching actions when said sheets on said tray reach a prescribed storage limit.

16. A sheet sorting device as claimed in claim 14, wherein said sheet-empty detecting means includes a sheet-empty actuating member disposed on said rotational shaft, and a sheet-empty switch opposite to said sheet-empty actuating member for performing switching actions in accordance with rotation of said sheet-empty actuating member, and a sheet-full actuating member connected to said rotational shaft and a sheet-full switch opposite to said sheet-full actuating member for performing switching action when said sheets on said tray reach a prescribed storage limit.

17. A sheet sorting device as claimed in claim 16, wherein said sheet-empty actuating member and said sheet-empty switch are of a non-contact switching mechanism, and said sheet-full actuating member and said sheet-full switch are of a non-contact switching mechanism.

18. A sheet sorting device as claimed in claim 17, wherein said sheet-empty switch and said sheet-full switch are fixed on said device body.

19. A sheet sorting device comprising a device body, trays each having a sheet support surface on which one or more sheets are stacked, said trays including an uppermost tray, one or more lower trays and a lowermost tray, sheet-empty and sheet full detecting means incorporated in each of said trays for detecting one or more sheets existing on said tray, said sheet-empty detecting means having sheet-empty detection lever rockingly supported by a rotational shaft rotatably mounted under said sheet support surface, said sheet-full detecting means incorporated in each of said trays for detecting the sheets stacked on said lower tray beneath said tray provided with said sheet-full detecting means when said sheets on said lower tray reach a prescribed storage limit, said sheet-full detecting means having one or more sheet-full detection levers rockingly supported by a rotational shaft rotatably mounted under said sheet support surface.

20. A sheet sorting device as claimed in claim 19, wherein said trays are detachably attached to said device body, said trays being adjacent to one another to form sheet storing spaces variable by detaching at least one of said trays from said device body.

21. A sheet sorting device as claimed in claim 19, wherein said trays are movable vertically, said trays being adjacent to one another to form sheet storing spaces variable by being moved vertically.

22. A sheet sorting device as claimed in claim 19, wherein said trays except for said lowermost tray are provided with said sheet-full detecting means.

23. A sheet sorting device as claimed in claim 19, further comprising means for transporting the sheets introduced into said device to said trays in order.

24. A sheet sorting device as claimed in claim 23, further comprising an indexer for introducing the sheet into a specified one of said trays.

* * * * *